United States Patent [19]

Kilby

[11] Patent Number: 4,969,590

[45] Date of Patent: Nov. 13, 1990

[54] TOP-LOADING STAPLER

[75] Inventor: Frank N. Kilby, Lawndale, Calif.

[73] Assignee: Eldon Industries, Inc., Inglewood, Calif.

[21] Appl. No.: 446,086

[22] Filed: Dec. 5, 1989

[51] Int. Cl.[5] ..... B25C 5/16

[52] U.S. Cl. ..... 227/128; 227/126

[58] Field of Search ..... 227/128, 125, 126, 127

[56] References Cited

U.S. PATENT DOCUMENTS

| | | | |
|---|---|---|---|
| 2,717,382 | 9/1955 | Ruskin | 227/125 |
| 4,666,075 | 5/1987 | Olesen | 227/128 |

FOREIGN PATENT DOCUMENTS

| | | | |
|---|---|---|---|
| 1001969 | 2/1957 | Fed. Rep. of Germany | 227/128 |
| 786360 | 11/1957 | United Kingdom | 227/127 |

*Primary Examiner*—Paul A. Bell
*Assistant Examiner*—John M. Husar
*Attorney, Agent, or Firm*—Price, Gess & Ubell

[57] ABSTRACT

An improved top-loading stapler having an internal mechanism for temporarily preventing the upper member of the stapler from closing during a loading operation. The improvement consists of an internal U-shaped spring clip that is attached to the upper member. The arms of the spring clip may be biased against the lower member such that the upper member is temporarily held in the open position under the frictional force between the arms of the spring clip and the lower member. The arms of the spring clip may also include inwardly extending detents, such that when the upper member may be positively held in the open position as the detents rest on the top of the lower member.

6 Claims, 3 Drawing Sheets

TOP-LOADING STAPLER

BACKGROUND OF THE INVENTION

1. Field of the Invention

The present invention relates generally to staplers and more particularly to an improved top-loading stapler.

2. Description of the Prior Art

Because of the great number of staplers that are in use today, it is not deemed necessary to set forth such devices in every detail. It is sufficient to note that most, if not all, staplers have a an upper strike member and a longitudinally adjacent staple guide, both of which are pivotally supported by a base.

However, there are a variety of ways in which staples are loaded into the staple guide. A partial categorization of loading schemes would include: (1) front-loading staplers of the type where an internal staple guide may be longitudinally extended forward for insertion of the staples thereon; (2) rear-loading staplers of the type where an internal staple guide may be longitudinally extended rearward for insertion of staples thereon; and (3) top-loading staplers of the type where the upper strike member may be separated from the staple guide by pivoting the strike member up and out of the way for insertion of staples into the staple guide.

It is the latter type of stapler towards which the present invention is directed and therefore, a prior art top-loading stapler will now be described in greater detail. Top-loading staplers are generally comprised of a base that has a staple guide rail and an upper strike member pivotally connected thereto. Also included is a biasing means such as an ordinary spring or a flat metallic spring coil that extends at least from the front of the upper strike member and over the staples to a staple pusher so as to bias the staples towards the front of the staple guide rail.

In a loading operation, the upper strike member of a top-loading stapler is opened by pivoting the upper strike member up and out of the way about the pivot point on the base. The staple guide rail typically remains in a roughly horizontal position and the staple pusher is moved to the rear of the staple guide rail because of its spring-loaded connection to the upper strike member.

A problem that has been experienced with the prior art top-loading staplers is that when a loading operation is being performed, the spring connection between the opened upper strike member and the stapler pusher is in tension such that the upper strike member tends to be biased towards a closed position.

A user must typically use one hand to maintain the open position of the upper strike member while using the other hand to insert the staples in the guide rail. Where the connecting spring is particularly strong, the user may even need to somehow manage to grasp both the upper strike member and the base while simultaneously attempting to load the staples. The frequent results of attempting to load a top-loading stapler include user frustration, pinched fingers, and broken staple blocks that the user was attempting to load.

A typical solution to the above problem involves leaving a notch in the rear of the base so that when the upper strike member is pivotally opened, it may be rested in a nearly horizonal position. Hence, rather than tending to close the upper strike member, the spring force is dissipated by harmlessly pulling the upper strike member against its pivotal joint. However, a notch in the base is not aesthetically pleasing. Moreover, a user may still end up with pinched fingers if the user fails to fully open the upper strike member.

SUMMARY OF THE INVENTION

It is an object of the present invention to provide an improved top-loading stapler that overcomes the problems associated with prior art top-loading staplers.

In particular, it is an object of the present invention to provide a top-loading stapler where the user is less likely to receive pinched fingers during a loading operation;

It is a further object of the present invention to provide a top-loading stapler where the user is less likely to break the staple blocks during a loading operation;

It is a further object of the present invention to provide a top-loading stapler where the user does not need to use both hands during a loading operation;

It is a further object of the present invention to provide a top-loading stapler where the upper strike member will tend to stay in an open position during a loading operation without need for providing a notch in the base or other unsightly method; and It is a further object of the present invention to provide a top-loading stapler where the upper strike member may be caused to temporarily stay in an open position even where the aesthetic design of the stapler is such that the upper strike member is mechanically prohibited from opening further than approximately ninety degrees with respect to the base.

The present invention achieves the above objects by providing a top-loading stapler where, during a loading operation, the upper strike member is frictionally and/or positively locked into an open position. In particular, the present invention discloses an improved stapler having a base, a pivoting upper member, and a support block attached to the base for pivotally supporting the pivoting upper member such that the pivoting upper member may be moved between a closed and an open position, the improvement comprising means for temporarily retaining the pivoting upper member in the open position.

The features of the present invention which are believed to be novel are set forth with particularity in the appended claims. The present invention, both as to its organization and manner of operation, together with further objects and advantages thereof, may best be understood by referencing the following description in conjunction with the accompanying drawings.

DETAILED DESCRIPTION OF THE PREFERRED EMBODIMENT

Figure 1:
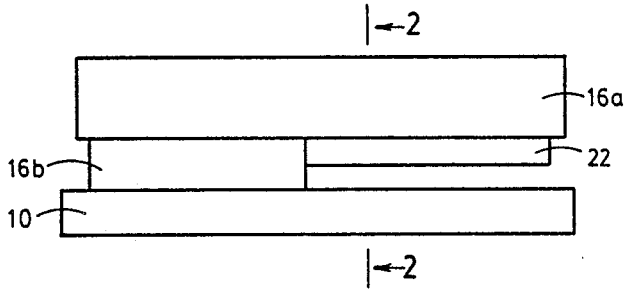
FIG. 1 is a side elevational view of a top-loading stapler in a closed position.

A typical top-loading stapler to which the present invention relates is illustrated in FIG. 1. As shown, a top-loading stapler is comprised of a base 10, a staple guide rail 22 and an upper strike member 16 that, as shown, may be comprised of an upper portion 16a and a lower portion 16b.

Figure 3:
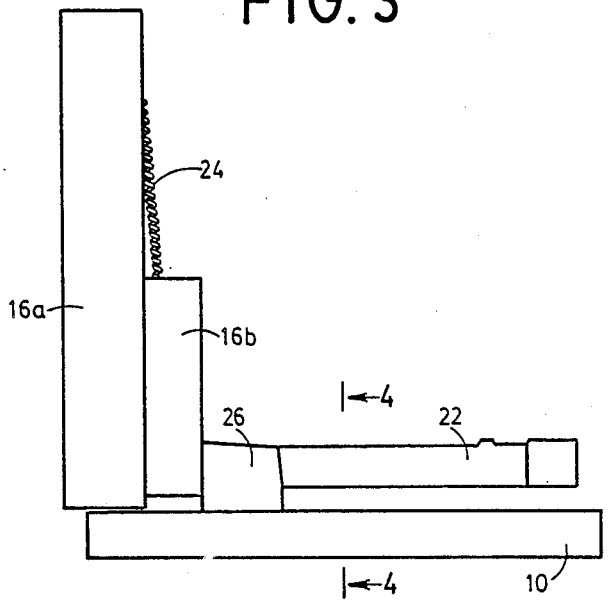
FIG. 3 is a side elevational view of the top-loading stapler of FIG. 1 taken with the stapler in the open position for loading.

FIG. 3 supplements FIG. 1 by illustrating the top-loading stapler of FIG. 1 in an open position where a biasing means 24 (such as spring) is visible. During a loading operation, the upper strike member 16a, 16b is pivoted about a support block 26 so that a user may insert a new staple block into the interior of the staple guide rail 22. As can be seen by FIG. 3, the rotation of upper strike member 16a, 16b is limited. Such rotational limitation is in part due to an internally offset pivot point (not shown) in order to aesthetically hide the support block 26 when the stapler is in a closed position (FIG. 1).

Figure 2:
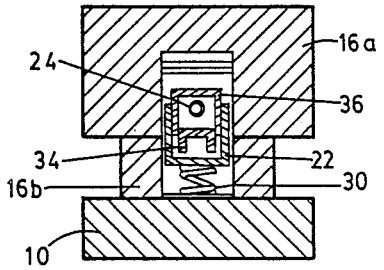
FIG. 2 is a cross-sectional view of the closed stapler of FIG. 1 along line 2—2.

FIG. 2 is a cross-sectional view of FIG. 1 taken along line 2—2 and is provided in order to help illustrate the relation between the spring 24 and the various other stapler components. As shown, this particular stapler includes stapler guide rail 22 and also an inner guide rail 34 on which the staples (not shown) may be placed. An upper rail 36 that is used for driving individual staples is located above the inner guide rail 22. Spring 30 is present in order to bias the upper strike member 16a, 16b and the other components away from the base 10.

Figure 6A:
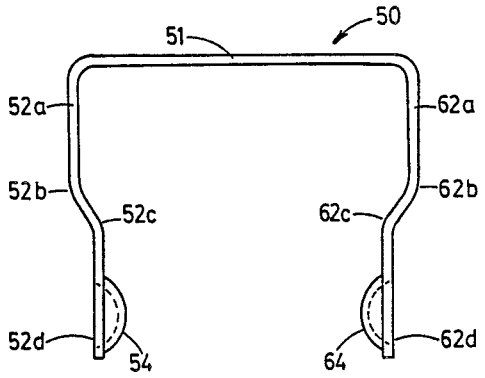
FIGS. 6a, 6b, and 6c are a top plan view, a side elevational view, and a front elevational view, respectively, of a preferred embodiment of a detented spring clip according to the present invention.
Figure 6B:
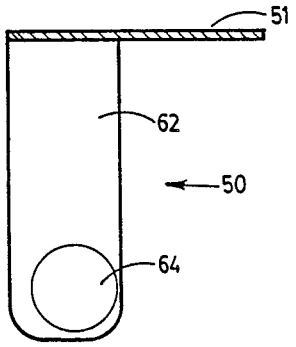
Figure 6C:
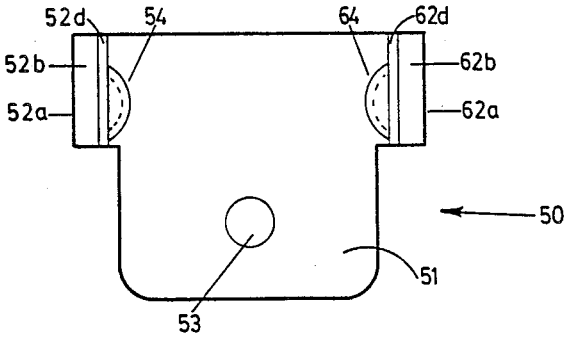

As discussed earlier, it is desirable to temporarily maintain the upper strike member 16a, 16b in an open position as shown in FIG. 3. A preferred means for temporarily restraining the upper strike member is illustrated in FIGS. 6a–6c. FIGS. 6a–6c illustrate a detented spring clip 50 this is comprised of a substantially flat central portion 51 and two outwardly extending arms 52 and 62. Finally, each arm 52, 62 has an inwardly extending detent 54 and 64, respectively. In a preferred embodiment, the detented spring clip 50 is made of a resilient material such as spring steel or nylon. Where the spring clip 50 is metallic, the detents may be made by pressing the material on the opposite side at the appropriate spots, and the clip then bent into the illustrated shape. A mounting hole 53 may also be included for mounting the spring clip 50 with a pop rivet or other similar fastening means.

With specific reference to arm 52 only, it may be seen that each arm 52, 62 is comprised of a first straight section 52a that is substantially perpendicular to the central portion 51, a first bend 52b, a second bend 52c, and a second straight section 52d that is substantially parallel to the central portion 51. The inwardly narrowing shape of the arms 52, 62 provides a means for exerting pressure against any object that is pressed between the opposed detents 54, 64.

Figure 4:
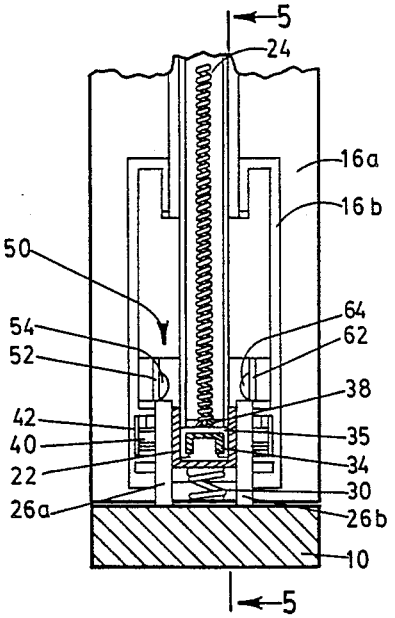
FIG. 4 is a combined cross-sectional and elevational view of FIG. 3 along line 4—4 and serves to illustrate the location and operation of a detented spring clip according to the present invention.

FIG. 4 is a combined elevational and cross-sectional view (taken along line 4—4) of the open stapler shown in FIG. 3 and serves to illustrate the use of the detented spring clip 50 according to the present invention. The detented spring clip 50 is mounted to the inner side of the upper portion 16a of the upper strike member via mounting hole 53 (or other suitable mounting means). The actual method of mounting the spring clip 50 to the upper portion of the strike member is not depicted because of the variety of ways in which mounting may be achieved, all of which are known to those skilled in the art.

It can readily be seen from FIG. 4 that the detents 54, 64 of the detented spring clip 50 are biased against the walls 26a, 26b of the support block 26. When the upper strike member 16a, 16b of the stapler is rotated into an open position, the detents 54, 64 slide along the exterior walls 26a, 26b of support block 26. When the strike member is rotated to its most open position, the detents 54, 64 are brought above the support block 26 and press inward so as to rest on the upper side of the support block walls 26a, 26b. In this final position, the upper strike member 16a, 16b is temporarily maintained in the open position. The user need merely overcome the biasing force of the spring detented clip 50 in order to close the stapler.

Figure 5:
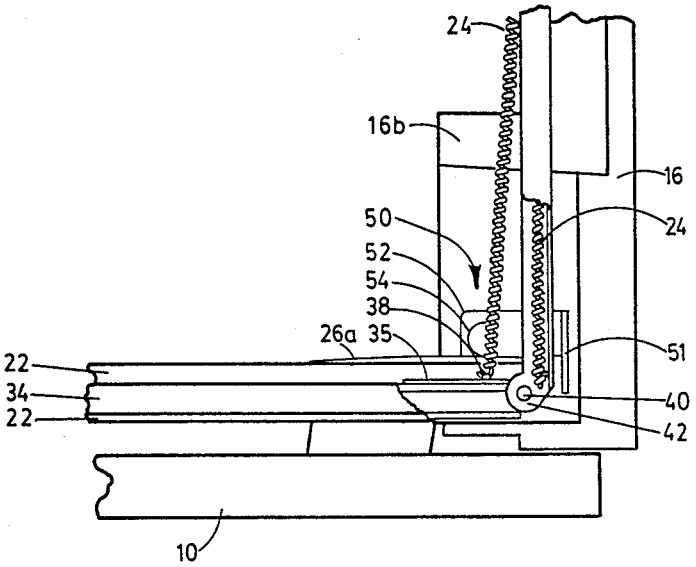
FIG. 5 is a combined cross-sectional (taken along line 5—5) and partial cut-away view of the opposite side of the stapler of FIG. 3 and serves to further illustrate the location and operation of a detented s clip according to the present invention.

FIG. 5 is a combined cross-sectional and partial cutaway view of the open stapler shown in FIG. 3. FIG. 5 further illustrates the interrelation between one support block wall 26a and detent 52 of the detented spring clip 50. As shown, the upper strike member 16 has a bearing means 40 that pivotally engages pivot points 40 that extend outwardly from the support block 26. Spring 24 extends upward from near the pivot point 40, 42, over a bearing located at the distal end of the upper strike member 16 (not shown), and then down where it is connected to a hook 38 located on the upper side of a staple pusher 35. The staple pusher 35, under the force of the spring 24, pushes forward any staples that are present on the inner guide rail 22.

When the stapler is in the open position, spring clip 50 prevents the upper strike member 16 from prematurely closing under the force of spring 24.

While the above features of the present invention teach an improved top-loading stapler, it can be readily appreciated that it would be possible to deviate from the above embodiments of the present invention and, as will be readily understood by those skilled in the art, the invention is capable of many modifications and improvements within the scope and spirit of the present invention. Accordingly, it will be understood that the invention is not to be limited by the specific embodiment but only by the spirit and scope of the appended claims.

I claim:

1. In a stapler having a base, a pivoting upper member, and a support block having opposing walls and a top attached to the base for pivotally supporting the pivoting upper member such that the pivoting upper member may be pivoted between a closed and an open position, the improvement comprising:

a substantially U-shaped clip connected to said pivoting upper member, said clip including a substantially flat central portion and first and second resilient arms extending outwardly therefrom so as to be adjacent to the walls of said support block when said pivoting upper member is in a closed position; and first and second inwardly extending detentes located at the distal ends of the first and second resilient arms, respectively, said detentes being slidably biased against the walls of said support block creating a frictional contact therebetween;

whereby said detentes will slide along the walls of said support block as the pivoting upper member is pivoted to the open position and whereby said frictional contact will temporarily retain said pivoting upper member in the open position.

2. The stapler of claim 1 wherein the detentes are located above the walls of said support block when the pivoting upper member is in the open position such that the detentes may rest on top of said walls to assist in retaining the pivoting upper member in the open position.

3. The stapler of claim 1 wherein the detentes are substantially hemispherical in shape.

4. The stapler of claim 1 wherein the detentes are substantially half-cylindrical in shape.

5. The stapler of claim 1 wherein the U-shaped clip is metallic.

6. The stapler of claim 1 wherein the U-shaped clip is plastic.

* * * * *